US010202172B2

(12) United States Patent
Van Diepen

(10) Patent No.: US 10,202,172 B2
(45) Date of Patent: Feb. 12, 2019

(54) ARTICULATING TUG BARGE HULL

(71) Applicant: NaviForm Consulting & Research Ltd., Vancouver (CA)

(72) Inventor: Peter Van Diepen, Vancouver (CA)

(73) Assignee: NaviForm Consulting & Research LTD., Vancouver (CA)

( * ) Notice: Subject to any disclaimer, the term of this patent is extended or adjusted under 35 U.S.C. 154(b) by 0 days.

(21) Appl. No.: 15/286,139

(22) Filed: Oct. 5, 2016

(65) Prior Publication Data

US 2018/0093741 A1 Apr. 5, 2018

(51) Int. Cl.

| | |
|---|---|
| ***B63B 35/70*** | (2006.01) |
| ***B63B 7/04*** | (2006.01) |
| ***B63B 1/12*** | (2006.01) |
| *B63B 7/00* | (2006.01) |
| *B63B 35/68* | (2006.01) |

(52) U.S. Cl.

CPC ..... *B63B 7/04* (2013.01); *B63B 1/121* (2013.01); *B63B 35/70* (2013.01); *B63B 35/68* (2013.01); *B63B 2007/003* (2013.01)

(58) Field of Classification Search

CPC ..... B63B 7/04; B63B 1/121
USPC ..... 114/61
See application file for complete search history.

(56) References Cited

U.S. PATENT DOCUMENTS 3,446,173 A * 5/1969 Ohcho ..... B63B 35/665 114/248
3,605,675 A * 9/1971 Clemence ..... B63B 35/70 114/248
3,735,722 A * 5/1973 Hooper ..... B63B 35/665 114/248
3,837,315 A * 9/1974 Giblon ..... B63B 35/70 114/248
3,910,219 A * 10/1975 Ono ..... B63B 35/70 114/248
3,993,014 A * 11/1976 Hooper ..... B63B 35/70 114/248
4,041,888 A * 8/1977 Hooper ..... B63B 35/70 114/248
6,199,501 B1 * 3/2001 Kuhlman ..... B63B 35/665 114/248
8,844,459 B2 * 9/2014 Perez ..... B63B 35/70 114/144 RE
8,967,174 B1 * 3/2015 Perreault ..... B63B 21/56 137/1
9,546,759 B2 * 1/2017 Van Tassel ..... F16L 55/1015
(Continued)

FOREIGN PATENT DOCUMENTS

| | | |
|---|---|---|
| CA | 1188162 | 6/1985 |
| GB | 1207343 | 9/1967 |
| RU | 2014204354 | 12/2014 |

*Primary Examiner* — S. Joseph Morano
*Assistant Examiner* — Jovon E Hayes
(74) *Attorney, Agent, or Firm* — Richard D. Okimaw

(57) ABSTRACT

A ship hull comprises a first hull portion extending along a first centerline and having a leading surface and a second hull portion extending along a second centerline and having a trailing surface. The ship hull further comprises a pivot connection between the leading surface of the first hull portion and the trailing surface of the second hull portion. The first portion has an outline sized and shaped to be received within a corresponding cavity of the trailing surface of the second hull potion with a substantially constant gap therebetween.

13 Claims, 3 Drawing Sheets

(56) References Cited

U.S. PATENT DOCUMENTS

| | | | | |
|---|---|---|---|---|
| 2002/0096100 | A1 | 7/2002 | Nuss | |
| 2012/0324910 | A1* | 12/2012 | Shete | B63B 35/28 65/53.2 |
| 2013/0032073 | A1* | 2/2013 | Becker | B63B 21/56 114/248 |
| 2014/0290281 | A1* | 10/2014 | Waller | F17C 1/002 62/53.2 |

* cited by examiner

ARTICULATING TUG BARGE HULL

BACKGROUND OF THE INVENTION

1. Field of Invention

The present invention relates generally to shipping and in particular to an articulated tug barge hull.

2. Description of Related Art

In waterborne transportation, one common method to transport cargo is through the use of the barge. One method of providing propulsion to barges is through the use of an articulated tug barge, commonly known as an ATB, in which the tugboat is connected to a barge with pins, over which the tug can rotate, as illustrated in FIGS. 1 and 2 at 10. In such prior art vessels, the barge 12 is provided with a notch or cutout 20 into the rear thereof. The tugboat 14 is located within the notch 20 and connected to the barge 12 through the use of a horizontal pivots connections 22. Advantages of that arrangement are that only a single tugboat is then required to provide propulsion for the barge. Additionally, regulations commonly permit less crew members to be located on such an articulated tug barge in comparison to a similarly sized transport ships.

ATBs in current use may suffer from increased resistance when moving through the water. In particular, conventional tugboat hulls are commonly designed for use in open water whereas the notches in the barges commonly have vertical sides, as illustrated in FIG. 2. Such arrangement therefore produces a substantial gap between the barge 12 and the tugboat 14, as generally indicated at 16 in FIG. 1. It will be appreciated that such gaps will produce turbulent flow therein, decreasing the efficiency of the combined vessel and thereby requiring greater power and higher fuel consumption. Additionally, as illustrated in FIG. 1, conventional barges also commonly include substantially squared or flat sterns having significant gaps between the sides of the barge and the sides of the tugboat, causing further resistance due to pulling water within the region to each side of the tugboat behind the barge, as generally indicated at 18.

SUMMARY OF THE INVENTION

According to a first embodiment of the present invention there is disclosed a ship hull comprising a first hull portion extending along a first centerline and having a leading surface and a second hull portion extending along a second centerline and having a trailing surface. The ship hull further comprises a pivot connection between the leading surface of the first hull portion and the trailing surface of the second hull portion. The first portion has an outline sized and shaped to be received within a corresponding cavity of the trailing surface of the second hull portion with a substantially constant gap therebetween.

The pivot connection may extend perpendicular to the first and second centerlines of each of the first and second hull portions. The pivot connection may extend along a substantially horizontal axis transverse to the first and second hull portions.

The leading surface of the first hull portion may have a substantially convex cross section. The leading surface of the first hull portion and the trailing surface of the second hull portion may extend substantially along an arcuate path about the axis of the pivot. The leading surface of the first hull portion and the trailing surface of the second hull portion may extend along paths between 98% and 102% of a radius from the axis of the pivot. The first hull portion and the trailing surface of the second hull portion may extend along corresponding arcs to each other to maintain a consistent distance therebetween at all locations.

The leading surface of the first hull portion and the trailing surface of the second hull portion may have a gap distance therebetween of between 12 an 36 inches. The trailing surface of the second hull portion may include a vertical portion along the arcuate path. The vertical portion may have a height up to 72 inches.

The first hull portion may have a width at least 90% of the width of the second hull portion proximate to the second hull trailing surface. The second hull portion may include longitudinal side surfaces tapering towards the trailing surface thereof. The side surfaces of the second hull portion may be coplanar with corresponding side surfaces of the first hull potion. The first hull portion may have a width selected to be between 80% and 105% of a width of the second hull portion. The second hull portion may have end surfaces adjacent to the first hull portion. The end surfaces may have a width selected to be up to 10% of a width of said second hull portion.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
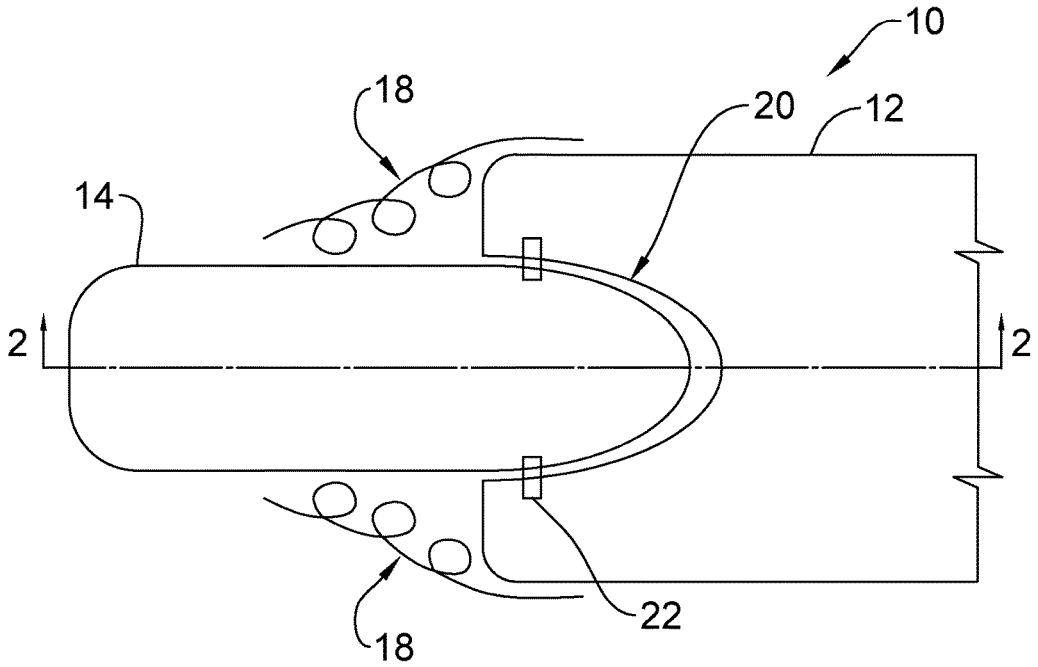
Figure 1 Prior Art
FIG. 1 is a top plan view of a prior art conventional articulated tug barge (ATB).
Figure 2:
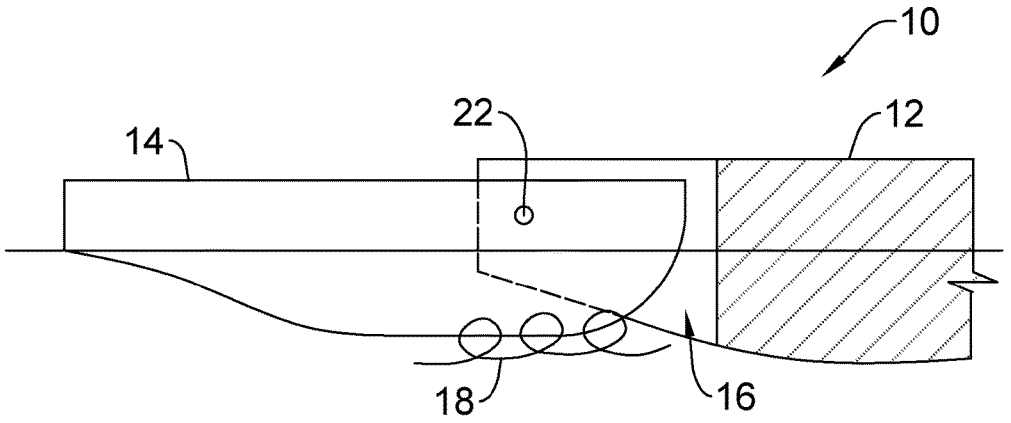
Figure 2 Prior Art
FIG. 2 is a side cross sectional view of a prior art conventional ATB as taken along the line 2-2 of FIG. 1.
Figure 3:
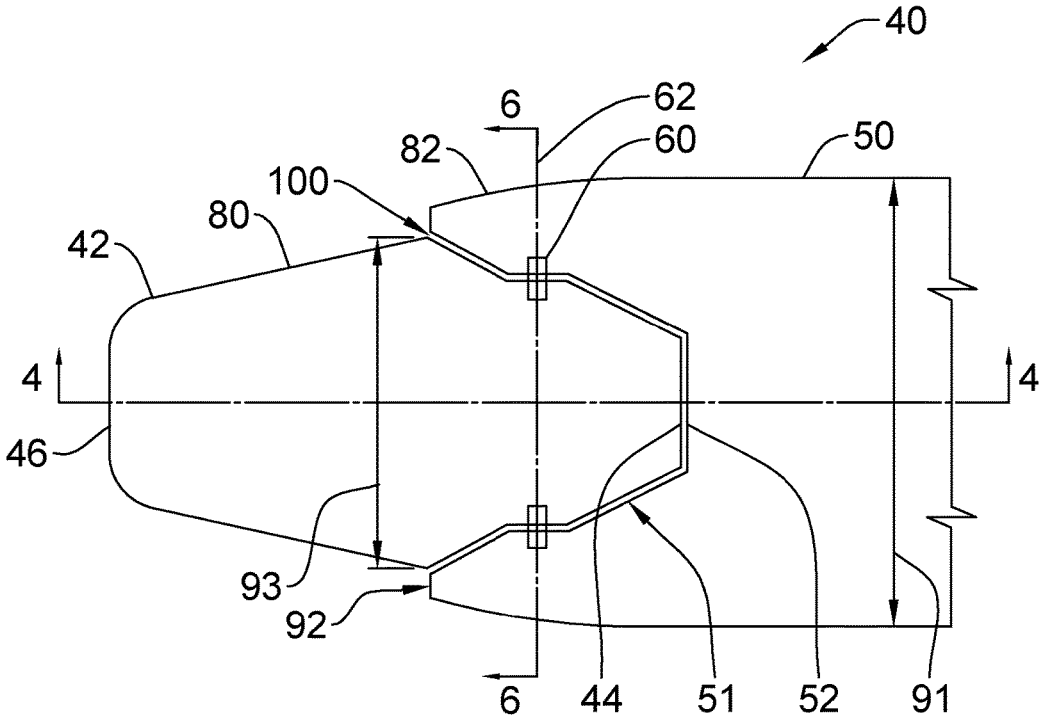
FIG. 3 is a top plan view of an ATB according to a first embodiment of the present invention.

Referring to FIG. 3, an articulated tug barge (ATB) hull according to a first embodiment of the invention is shown generally at 40. The ATB hull 40 comprises a first hull portion 42 and a second hull portion 50. The second hull portion 50 includes a notch, generally indicated at 51 into which the first hull portion 42 is received. The first and second hull portions 42 and 50 are connected to each other along a pivot connection 60 of any known type to permit the first and second hull portions to pivot relative to each other about a pivot axis 62.

The first hull portion 42 extends between leading and trailing surfaces 44 and 46, respectively. Similarly, the second hull portion 50 extends between leading (not shown) and trailing surfaces 52. As illustrated in FIG. 3, the trailing surface 52 of the second hull portion 50 forms the notch 51 into which the leading surface 44 of the first hull portion 42 is received.

Figure 4:
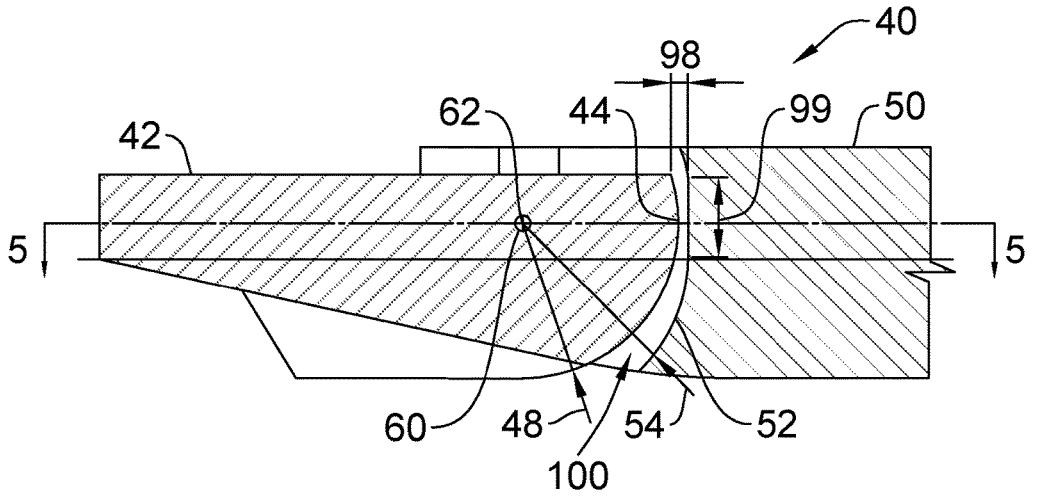
FIG. 4 is a side cross sectional view of the ATB of FIG. 3 as taken along the line 4-4.

Turning now to FIG. 4, the leading surface 44 of the first hull portion 42 is formed along a first radius 48 having its center at the pivot axis 62. Similarly, the trailing surface 52 is also formed along a second radius 54 having its center at the pivot axis 62. It will be appreciated that in such industries, a perfect radius bend is difficult and often a near radial curvature will be provided. In practice it has been found that radii between 98 and 102% of the designated radius will be acceptable. In such a manner, the leading surface 44 of the first hull portion 42 and the trailing surface 52 of the second hull portion 50 form a gap, generally indicated at 100 therebetween. As each of the leading surface 44 of the first hull portion 42 and the trailing surface 52 of the second hull portion 50 are arcuate about a common axis 62, the gap 100 will have a substantially constant width therealong. In such a manner, the gap distance 98 between the first and second hull portions 42 and 50 may be minimized so as to prevent unwanted water turbulence from forming therein.

The gap distance 98 will be defined by the difference between the radius 54 and the radius 48 and may be selected to be minimized while maintaining proper clearances for operation in marine environments. By way of non-limiting example, the gap distance 98 may be selected to be between 12 and 36 inches (305 and 914 mm) although it will be appreciated that other distances may be selected depending upon the use and environment. As illustrated in FIG. 4, the second radius 54 may be larger than the first radius 48 so as to be spaced apart therefrom at the top and bottom of the gap 100. Furthermore, the second radius 54 may include a vertical portion, generally indicated at 99 so as to permit accommodation between the relative draft between the first and second hull portions 42 and 50. In practice it has been found that a vertical portion of up to 72 inches (1829 mm) has been useful although it will be appreciated that other distances may be useful as well.

With reference to FIG. 3, the first hull portion 42 may have first side surfaces 80 extending therealong. Similarly, the second hull portion 50 may also have second side surfaces 82 exiting therealong. As illustrated in FIG. 3, the first and second side surfaces 80 and 82 may be substantially coplanar with each other so as to present a substantially constant surface to each side of the gap 100.

As illustrated in FIG. 3, the first hull portion 42 may have a first hull width indicated generally at 93 whereas the second hull portion 50 may have a second hull width generally indicated at 91. The first hull width 93 may be selected to be between 80% and 105% of the second hull width 91 although it will be appreciated that other ratios may also be useful. Furthermore, as illustrated the second hull portion 50 may include barge ends generally indicated at 92 selected to be up to 10% of the second hull width 91 although it will be appreciated that other dimensions may also be useful as well.

Figure 5:
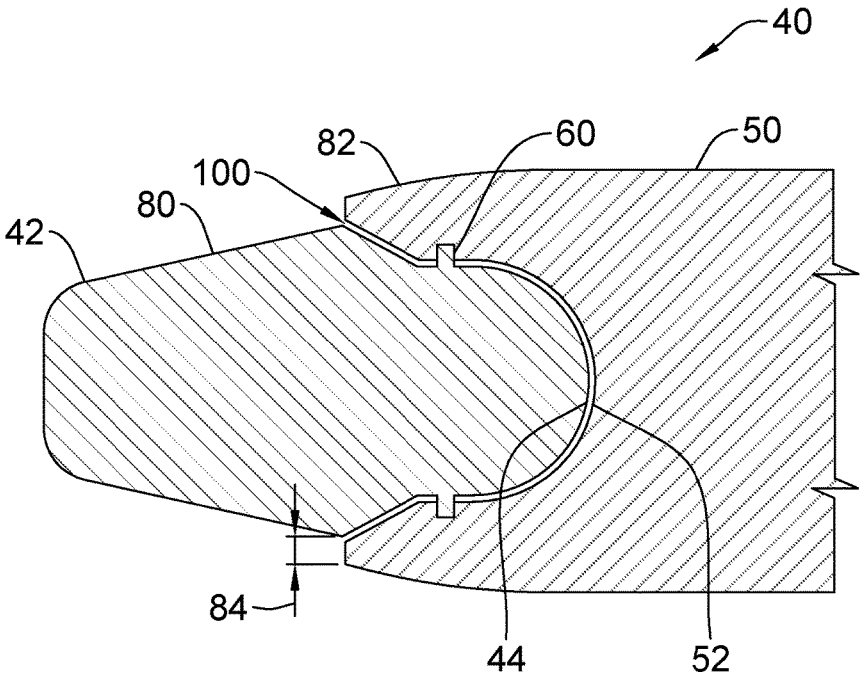
FIG. 5 is a cross sectional view of an articulated tug barge according to a further embodiment of the present invention as taken along the line 5-5 of FIG. 4.

Turning now to FIG. 5, it will be appreciated that in some embodiments of the present invention, the first and second side surfaces 80 and 82 may be offset from each other by an offset distance 84. In such embodiments, it will be preferable to maintain the offset distances to a minimum to provide a reduced turbulence and drag behind the second hull portion 50. In particular, the offset distance 84 should be maintained to be less than 5% of the width of the trailing surface 52 of the second hull portion 50 so as to maintain the width of the first hull portion 42 as at least 90% of the width of the second hull portion 50 proximate to the gap 100.

Figure 6:
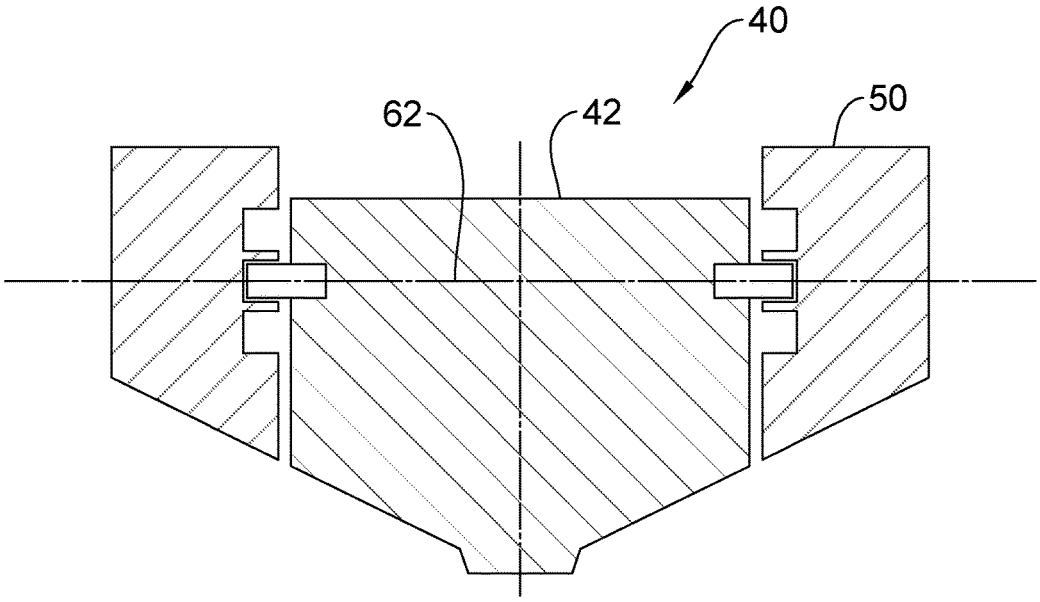
FIG. 6 is a side cross sectional view of the articulated tug barge of FIG. 3 as taken along the line 6-6.

It will be appreciated that any sidewall profile between the first and second hull portions 42 and 50 may be utilized. By way of non-limiting example, the side edges therebetween may be substantially vertical, as illustrated in FIG. 6, although it will be appreciated that other profiles may be utilized as well.

While specific embodiments of the invention have been described and illustrated, such embodiments should be considered illustrative of the invention only and not as limiting the invention as construed in accordance with the accompanying claims.

What is claimed is:

1. A ship hull comprising:

a first hull portion extending along a first centerline and having a leading surface;

a second hull portion extending along a second centerline and having a trailing surface;

a pivot connection between said leading surface of said first hull portion and said trailing surface of said second hull portion; and wherein said leading surface of said first hull portion extends substantially along a first arcuate path on a vertical plane about an axis of said pivot connection and said trailing surface of said second hull portion extends substantially along a second arcuate path on said vertical plane about said axis of said pivot connection, wherein said first hull portion has an outline sized and shaped to be received within a corresponding cavity of said trailing surface of said second hull portion with a substantially constant gap therebetween wherein said first hull portion has a width at least 90% of a width of said second hull portion at a location proximate to a trailing edge of said second hull portion.

2. The apparatus of claim 1 wherein said pivot connection extends perpendicular to said first and second centerlines of each of said first and second hull portions.

3. The apparatus of claim 2 wherein said pivot connection extends along a substantially horizontal axis transverse to said first and second hull portions.

4. The apparatus of claim 1 wherein said leading surface of said first hull portion and said trailing surface of said second hull portion extend along paths between 98% and 102% of a radius said axis of said pivot connection.

5. The apparatus of claim 1 wherein said first hull portion and said trailing surface of said second hull portion extend along corresponding arcs to each other to maintain a consistent distance therebetween at all locations.

6. The apparatus of claim 1 wherein said first hull portion and said trailing surface of said second hull portion have a gap distance therebetween of between 12 and 36 inches.

7. The apparatus of claim 1 wherein said trailing surface of said second hull portion includes a vertical portion along said second arcuate path.

8. The apparatus of claim 7 wherein said vertical portion has a height up to 72 inches.

9. The apparatus of claim 1 wherein said second hull portion includes longitudinal side surfaces tapering towards said trailing surface thereof.

10. The apparatus of claim 9 wherein said side surfaces of said second hull portion are coplanar with corresponding side surfaces of said first hull portion.

11. The apparatus of claim 1 wherein said width of said first hull portion is selected to be between 80% and 105% of a width of said second hull portion.

12. The apparatus of claim 1 wherein said second hull portion has end surfaces adjacent to said first hull portion.

13. The apparatus of claim 12 wherein said end surfaces have a width selected to be up to 10% of a width of said second hull portion.

* * * * *